US008908892B2

(12) United States Patent
Bäuml et al.

(10) Patent No.: US 8,908,892 B2
(45) Date of Patent: Dec. 9, 2014

(54) METHOD AND DEVICE FOR FREQUENCY COMPRESSION IN A HEARING AID

(75) Inventors: Robert Bäuml, Eckental (DE); Ulrich Kornagel, Erlangen (DE); Thomas Pilgrim, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 349 days.

(21) Appl. No.: 13/248,162

(22) Filed: Sep. 29, 2011

(65) Prior Publication Data

US 2012/0076335 A1 Mar. 29, 2012

(30) Foreign Application Priority Data

Sep. 29, 2010 (DE) ..... 10 2010 041 643

(51) Int. Cl.
*H04R 25/00* (2006.01)

(52) U.S. Cl.
CPC ..... *H04R 25/353* (2013.01); *H04R 2225/43* (2013.01); *H04R 2430/03* (2013.01)
USPC ..... 381/316; 381/320

(58) Field of Classification Search
CPC ..... H04R 25/353; H04R 2225/43; H04R 2430/03
USPC ..... 381/316, 318, 320, 321, 317, 60, 98, 381/94.2, 94.3, 106
See application file for complete search history.

(56) References Cited

U.S. PATENT DOCUMENTS

| | | | | |
|---|---|---|---|---|
| 3,385,937 | A | 5/1968 | Lafon | |
| 7,248,711 | B2 * | 7/2007 | Allegro et al. | 381/316 |
| 2004/0264721 | A1 * | 12/2004 | Allegro et al. | 381/316 |
| 2006/0253209 | A1 | 11/2006 | Hersbach et al. | |
| 2007/0253585 | A1 | 11/2007 | Steinbuss | |
| 2009/0290737 | A1 | 11/2009 | Alfsmann | |
| 2010/0198603 | A1 * | 8/2010 | Paranjpe | 704/500 |
| 2011/0150256 | A1 * | 6/2011 | Baechler et al. | 381/316 |

FOREIGN PATENT DOCUMENTS

| | | | |
|---|---|---|---|
| DE | 1261169 | B | 2/1968 |
| DE | 10 2006 019 728 | A1 | 11/2007 |
| EP | 1441562 | A2 | 7/2004 |
| EP | 1686566 | A2 | 8/2006 |
| EP | 2124335 | A2 | 11/2009 |
| WO | 0075920 | A1 | 12/2000 |

* cited by examiner

*Primary Examiner* — Fan Tsang
*Assistant Examiner* — Eugene Zhao
(74) *Attorney, Agent, or Firm* — Laurence A. Greenberg; Werner H. Stemer; Ralph E. Locher

(57) ABSTRACT

A hearing aid device suitable for executing a frequency compression is optimized to achieve a better assignment between channels of a source frequency range and channels of a target frequency range. A frequency range that can be transmitted by the hearing aid device is split into a number of frequency bands, after which a number of adjacent frequency bands are combined into at least one group of frequency bands and then one frequency band is selected from each group of frequency bands. The selected frequency bands are moved respectively into a target frequency band permanently assigned to the respective group. This prevents that a number of frequency bands from the source frequency range are shifted to the same target frequency band.

5 Claims, 2 Drawing Sheets

METHOD AND DEVICE FOR FREQUENCY COMPRESSION IN A HEARING AID

CROSS-REFERENCE TO RELATED APPLICATION

This application claims the priority, under 35 U.S.C. §119, of German patent application DE 10 2010 041 643.6, filed Sep. 29, 2010; the prior application is herewith incorporated by reference in its entirety.

BACKGROUND OF THE INVENTION

Field of the Invention

The invention relates to a method for frequency compression of an input signal entering a hearing aid device, wherein a frequency range that can be transmitted by the hearing aid device is split into a number of frequency bands and wherein at least one source frequency band is moved to a target frequency band.

The invention also relates to a hearing aid device for performing such a method.

To compensate for a user's individual hearing loss, frequency-dependent amplification of an input signal entering the hearing aid device normally takes place in the hearing aid device. The dynamic range, i.e. the range between the hearing threshold and the discomfort threshold, is generally very limited for a hearing-impaired person compared with a person with normal hearing. Therefore modern hearing aid devices generally also perform dynamic compression by means of an automatic amplification or gain control AGC.

However there are hearing losses, with which hearing loss cannot be compensated for in a satisfactory manner by simple frequency-dependent amplification of an acoustic input signal. Examples of this are hearing losses with dead frequency ranges, in which spectral components of the acoustic input signal cannot be made audible even with a high level of amplification.

Commonly assigned Patent Application Publication US 2007/0253585 A1 and its counterpart German published patent application DE 10 2006 019 728 A1 describe a method for setting a hearing aid apparatus in which a portion of an input signal spectrum at a first frequency is amplified and shifted to a second frequency as a function of time, in order on the one hand to achieve a high level of spontaneous acceptance of the hearing system due to an almost undistorted sound pattern of the hearing system between two adaptation steps and on the other hand to assist the learning and acclimatization process of the hearing-impaired person in respect of the new frequency pattern.

One possibility for resolving the last-mentioned problem is so-called frequency compression. Here, spectral components within a source frequency range (typically at higher frequencies) are shifted to a target frequency range (typically at lower frequencies). Unlike the signal components of the acoustic input signal in the source frequency range, the signal components shifted to the target frequency range can be made audible to the user in question by amplification in this frequency range.

A prior art frequency compression method provides for the following method steps:

splitting a frequency range that can be transmitted by the hearing aid device into a number of frequency bands (channels);

selecting certain frequency bands above a predefined threshold frequency based on a sound energy criterion; and moving the selected frequency bands to target frequency bands based on a channel assignment function.

The algorithm here searches above the threshold frequency for a predefined number N of local energy maxima in the frequency spectrum above the threshold frequency. The width of an energy maximum above the frequency is not taken into account here. "Narrow" maxima can occur, which only lie in one frequency band. "Wide" maxima can also extend over several frequency bands. The frequency band in which it has the greatest energy is then selected for the local energy maximum. This frequency band is then shifted according to the channel assignment function to another, generally lower, frequency range.

The disadvantage here is that the number N is difficult to set. If the value of N is selected too low, gaps result in the target frequency range. If the value of N is selected too high, there will be selected frequency bands with energy maxima, which have to be shifted into the same target frequency band.

SUMMARY OF THE INVENTION

It is accordingly an object of the invention to provide a hearing aid with frequency compression which overcome the above-mentioned disadvantages of the heretofore-known devices and methods of this general type and which provides for a solution that achieves a better assignment between the channels of the source frequency range and the target frequency range.

With the foregoing and other objects in view there is provided, in accordance with the invention, a frequency compression method for an input signal of a hearing aid device, the method which comprises:

splitting a frequency range that can be transmitted by the hearing aid device into a plurality of frequency bands;

combining a number of mutually adjacent frequency bands into at least one group of frequency bands;

selecting one frequency band from the group of frequency bands, by selecting the frequency band with a greatest sound energy and/or a highest signal level within the group of frequency bands; and moving the selected frequency band to a target frequency band.

In other words, the basic concept of the invention is to combine a number of adjacent frequency bands of the source frequency range in each instance into a group of frequency bands and from each group of frequency bands to select just one frequency band, the "selected" frequency band or "winning" frequency band of the group, and move it to just one target frequency band assigned to the respective group. It is preferable here for the frequency band in which the energy maximum of the relevant group lies to be selected from each group of frequency bands.

In theory it is sufficient for the execution of the inventive method for only one group of frequency bands to be formed, from which one frequency band is shifted into the target frequency range. The advantages of the invention are however revealed in particular when two or more groups of frequency bands are formed.

The method can advantageously be employed in conjunction with a polyphase filter bank, which only generates the complex-valued, analytical signal (positive frequency component of a Fourier transformation) in the channels.

The invention predefines the number N of frequency bands to be shifted from the source frequency range to the target frequency range. Also combining adjacent frequency bands into groups of frequency bands prevents a number of frequency bands from the source frequency range being shifted to the same target frequency band.

With the above and other objects in view there is also provided, in accordance with the invention, a hearing aid that is specifically configured for performing the above-summarized method. The device comprises:

a filter bank (e.g., a polyphase filter bank) configured for splitting a frequency range that can be transmitted by the hearing aid device into a plurality of frequency bands;

means for dividing certain frequency bands into different groups of frequency bands;

means for selecting one frequency band from each group of frequency bands as a function of signal components of an input signal entering the hearing aid device in the individual frequency bands of the respective group of frequency bands, wherein the frequency band with a greatest sound energy and/or a highest signal level is selected within the group of frequency bands; and means for moving the respectively selected frequency band to a target frequency band.

Other features which are considered as characteristic for the invention are set forth in the appended claims.

Although the invention is illustrated and described herein as embodied in a hearing aid device for frequency compression, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
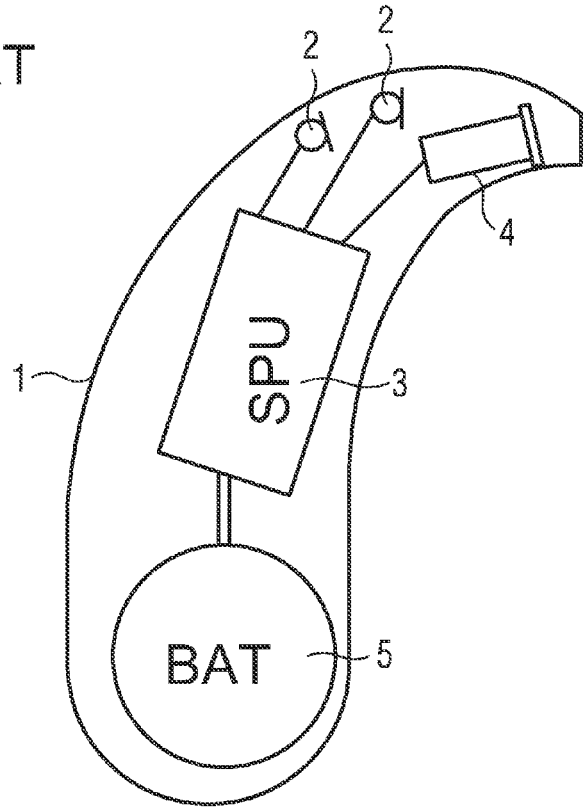
FIG. 1 PRIOR ART
FIG. 1 shows a simplified block circuit diagram of a hearing device according to the prior art.

Referring now to the figures of the drawing in detail and first, particularly, to FIG. 1 thereof, there is shown a highly simplified block circuit diagram of an example of the structure of a hearing aid device, here, a hearing device to be worn behind the ear, according to the prior art. The key components of hearing devices are an input transducer, an amplifier and an output transducer. The input transducer is generally a sound receiver, e.g. a microphone, and/or an electromagnetic receiver, e.g. an induction coil. The output transducer is generally in the form of an electroacoustic transducer, e.g. a miniature loudspeaker or earpiece, or an electromechanical transducer, e.g. a bone conduction earpiece. The amplifier is generally integrated in a signal processing unit SPU. In the exemplary embodiment according to FIG. 1 one or more microphones 2 for picking up sound from the environment are incorporated in a hearing device housing 1 to be worn behind the ear. A signal processing unit 3, which is likewise located in the hearing device housing 1, processes the microphone signals and amplifies them. The output signal of the signal processing unit 3 is transmitted to a loudspeaker or earpiece 4, which outputs an acoustic signal. The sound is optionally transmitted by way of a sound tube, which is fixed in the auditory canal by means of an otoplastic, to the eardrum of the user. Energy is supplied to the hearing device and in particular to the signal processing unit 3 by a battery 5 likewise disposed in the hearing device housing 1.

Figure 2:
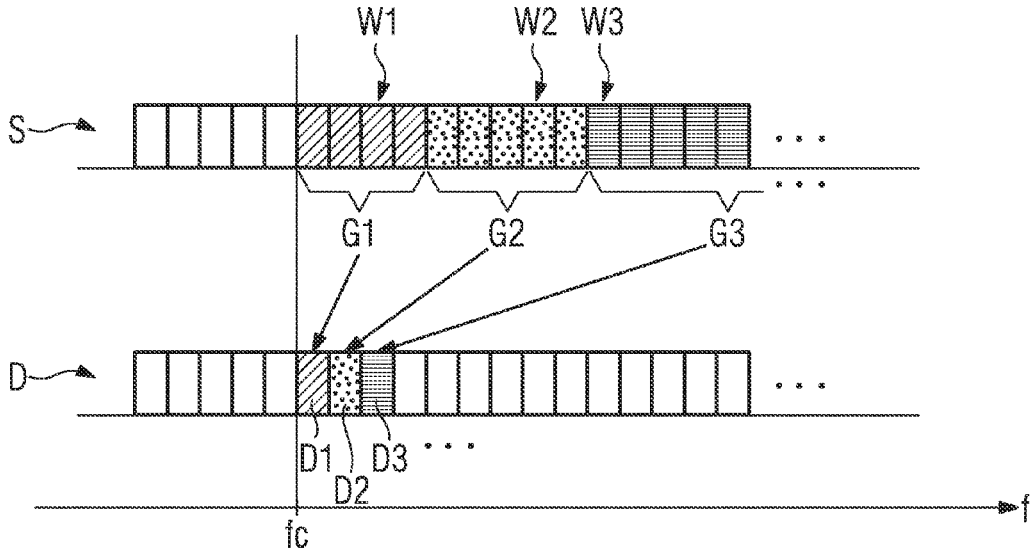
FIG. 2 shows the division of a number of frequency bands into different groups of frequency bands, the selection of a selected frequency band from each group of frequency bands and the movement of the respectively selected frequency band in each instance to a target frequency band assigned to the relevant group according to the invention.

FIG. 2 shows the splitting of the frequency range that can be transmitted by a hearing aid device into a plurality of frequency bands. In the exemplary embodiment the width of the frequency bands is the same for all frequency bands (e.g. 200 Hz), but this does not necessarily have to be the case. During frequency compression one source frequency range S is generally mapped or moved to a target frequency range D. Below a certain threshold frequency $f_c$ no frequency compression takes place in the exemplary embodiment and above the threshold frequency $f_c$ a certain number of adjacent frequency bands of the source frequency range are combined in each instance into a group of frequency bands. In the exemplary embodiment this is shown for groups G1, G2 and G3. The number of frequency bands within a group can vary between groups. Just one target frequency band D1, D2, D3, etc. is permanently assigned to each group of frequency bands G1, G2, G3, etc. A certain frequency band (the "winning frequency band") is selected from each group of frequency bands G1, G2, G3, etc.—e.g. for a certain time period—for example the frequency band, in which the signal component of the input signal has the highest signal level compared with the signal components in the other frequency bands of the group, and shifted to the target frequency band assigned to the group. In the exemplary embodiment the winning frequency bands W1, W2 and W3 were selected, as shown, and shifted to the frequency bands D1, D2 and D3. The other frequency bands of each group, i.e. those that were not selected, are not mapped to another frequency range and are therefore suppressed, at least from the point of view of the hearing-impaired user. Optionally frequency bands that are not selected and are therefore suppressed can also be actively suppressed, in other words attenuated or filtered out by filter means in the hearing aid device in respect of the input signal. It is also possible for signal components of the input signal to be suppressed in the output signal of a relevant hearing aid device, in that no further signal processing takes place for the relevant signal components after splitting into frequency bands.

Generally the signal component shifted from the selected frequency band W1, W2, W3 to the target frequency band is overlaid on the signal component of the input signal that is present anyway in the target frequency band. This can be done by simply adding the two signals but it is also possible to set a certain mixing ratio or different weighting of the signals. This can even mean that, for example, the signal component resulting directly from the input signal is entirely suppressed (filtered out) in the relevant frequency band and only the signal shifted out of the source frequency range to the target frequency band is processed further.

Figure 3:
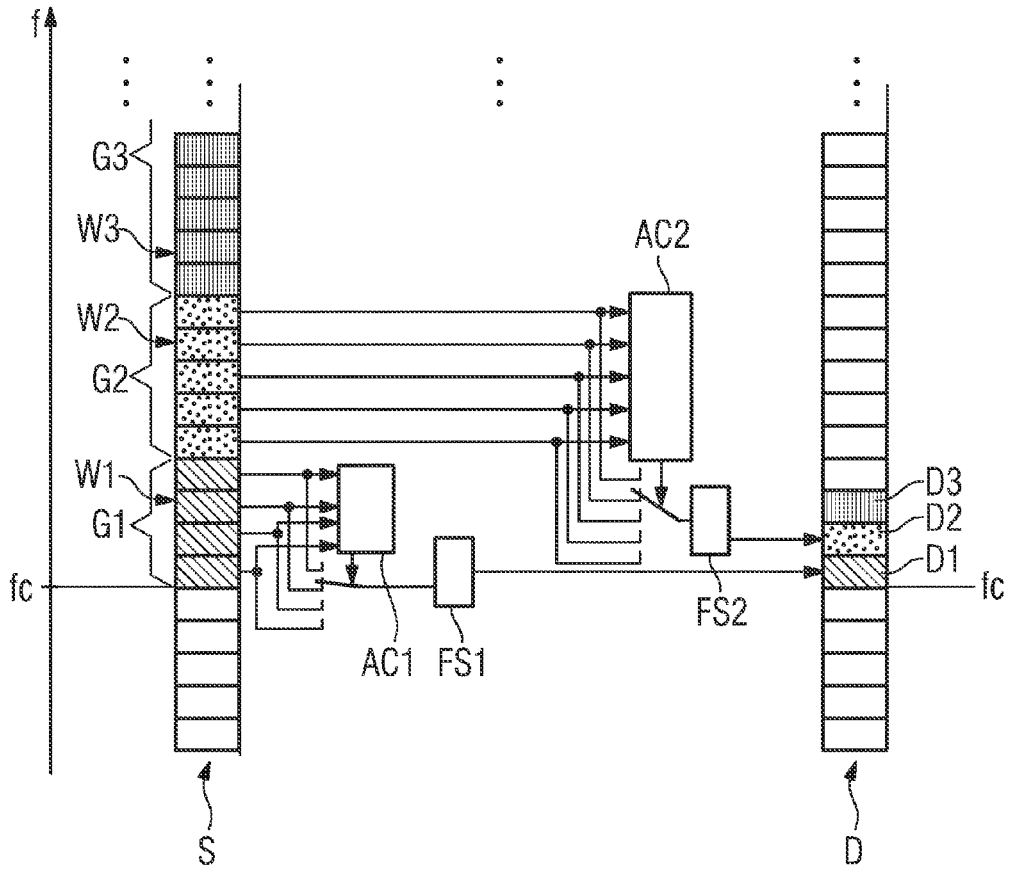
FIG. 3 shows the selection of one frequency band from each group of frequency bands and the movement of the selected frequency band in each instance to a target frequency band assigned to the relevant group.

FIG. 3 shows a segment of a block circuit diagram of an inventive hearing aid device of relevance to the invention. It comprises at least one filter bank for splitting a frequency range that can be transmitted by the hearing aid device into a plurality of frequency bands S. It also comprises means for dividing certain frequency bands into different groups G1, G2, G3, etc. of frequency bands. The division of the frequency bands can be set and matched to the individual hearing loss of a user for example by programming the hearing aid device. An inventive hearing aid device furthermore comprises means for selecting one frequency band W1, W2, etc. from each group G1, G2, G3, etc. of frequency bands as a function of the signal components of an input signal entering the hearing aid device in the individual frequency bands of the respective group G1, G2, G3, etc. of frequency bands. At least one signal analysis and evaluation unit AC1, AC2, etc. is present in the hearing aid device for selection purposes, determining for example the signal levels and/or energy present in the individual channels and setting the frequency band that has the highest signal level and/or the greatest energy for a certain time period as the "winning frequency band" W1, W2, etc. of the respective group G1, G2, G3, etc.

The inventive hearing aid device furthermore comprises means for moving the respectively selected frequency band W1, W2, etc. to a specific target frequency band D1, D2, D3, etc. of the target frequency range D. In the exemplary embodiment the frequency shifting units FS1 and FS2 are present for this purpose, each shifting or moving a certain frequency range to a different frequency range.

Figure 4:
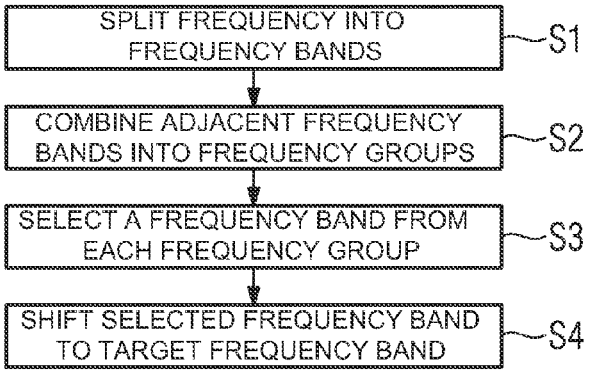
FIG. 4 is a flow diagram illustrating a sequence according to the invention.

FIG. 4 once again shows graphically the method steps executed in a method according to the invention during the frequency compression of an input signal entering a hearing aid device:

In a first method step S1 a frequency range that can be transmitted by the hearing aid device is split into a number of frequency bands. This causes an input signal entering the hearing aid device to be split into signal components in the respective frequency bands. Then in a method step S2 a number of adjacent frequency bands are respectively combined into at least one group of frequency bands. This is followed in a method step S3 for each group of frequency bands by the selection of one frequency band from the respective group. In the following method step S4 the selected frequency band is shifted to a target frequency band assigned to the respective group. The frequency bands of each group that are not selected are not processed further and are therefore suppressed.

The invention claimed is:

1. A frequency compression method for an input signal of a hearing aid device, the method which comprises:

splitting a frequency range that can be transmitted by the hearing aid device into a plurality of frequency bands;

combining a number of mutually adjacent frequency bands into at least one group of frequency bands;

selecting one frequency band from the group of frequency bands, by selecting the frequency band with a greatest sound energy and/or a highest signal level within the group of frequency bands; and moving a selected frequency band to a target frequency band and signal components moved to the target frequency band being made audible to a user of the hearing aid device.

2. The method according to claim 1, which comprises:

forming at least two groups of frequency bands; and moving amplitude components and phase components of the selected frequency band to the target frequency band.

3. The method according to claim 1, wherein the at least one group of frequency bands is one of a plurality of groups of frequency bands and permanently assigning exactly one target frequency band to each of the groups of frequency bands.

4. A hearing aid device for performing the method according to claim 1, comprising:

a filter bank configured for splitting a frequency range that can be transmitted by the hearing aid device into a plurality of frequency bands;

means for dividing certain frequency bands into different groups of frequency bands;

means for selecting one frequency band from each group of frequency bands as a function of signal components of an input signal entering the hearing aid device in the individual frequency bands of the respective group of frequency bands, wherein the frequency band with a greatest sound energy and/or a highest signal level is selected within the group of frequency bands;

means for moving the respectively selected frequency band to a target frequency band; and means for outputting audibly signal components moved to the target frequency band to a user of the hearing aid device.

5. The hearing aid device according to claim 4, wherein said filter bank is a polyphase filter bank.

* * * * *